US009246232B2

(12) United States Patent
Sauleau et al.

(10) Patent No.: US 9,246,232 B2
(45) Date of Patent: Jan. 26, 2016

(54) MULTILAYER PILLBOX TYPE PARALLEL-PLATE WAVEGUIDE ANTENNA AND CORRESPONDING ANTENNA SYSTEM

(75) Inventors: Ronan Sauleau, Acigné (FR); Mauro Ettorre, Rennes (FR)

(73) Assignees: Universite De Rennes 1, Rennes (FR); Centre National de la Recherche Scientifique, Paris (FR)

( * ) Notice: Subject to any disclaimer, the term of this patent is extended or adjusted under 35 U.S.C. 154(b) by 865 days.

(21) Appl. No.: 13/262,765

(22) PCT Filed: Mar. 29, 2010

(86) PCT No.: PCT/EP2010/054060

§ 371 (c)(1),
(2), (4) Date: Dec. 28, 2011

(87) PCT Pub. No.: WO2010/112443

PCT Pub. Date: Oct. 7, 2010

(65) Prior Publication Data

US 2012/0092224 A1 Apr. 19, 2012

(30) Foreign Application Priority Data

Apr. 2, 2009 (FR) ..... 09 52158

(51) Int. Cl.
*H01Q 13/00* (2006.01)
*H01Q 15/14* (2006.01)
(Continued)

(52) U.S. Cl.
CPC ..... *H01Q 19/138* (2013.01); *H01Q 3/18* (2013.01); *H01Q 13/22* (2013.01); *H01Q 19/17* (2013.01); *H01Q 21/005* (2013.01); *H01Q 21/064* (2013.01)

(58) Field of Classification Search
CPC ..... H01Q 3/24; H01Q 3/242; H01Q 3/245; H01Q 3/26; H01Q 21/00; H01Q 21/006; H01Q 21/0031; H01Q 21/0043; H01Q 21/0062; H01Q 19/13; H01Q 19/17; H01Q 19/104; H01Q 19/132; H01Q 19/134; H01Q 19/138; H01Q 19/18; H01Q 19/185; H01Q 15/16; H01Q 15/244; H01Q 15/246; H01Q 13/18; H01Q 13/22
USPC ..... 343/757, 762, 771, 772, 775, 776, 777, 343/779, 780, 912
See application file for complete search history.

(56) References Cited

U.S. PATENT DOCUMENTS 3,018,480 A * 1/1962 Thourel ..... 343/771
3,328,800 A * 6/1967 Algeo ..... 343/768
(Continued)

FOREIGN PATENT DOCUMENTS

WO 9117586 A1 11/1991

OTHER PUBLICATIONS

International Search Report dated May 20, 2010 for corresponding International Application No. PCT/EP2010/054060, filed Mar. 29, 2010.
(Continued)

*Primary Examiner* — Robert Karacsony
*Assistant Examiner* — Patrick Holecek
(74) *Attorney, Agent, or Firm* — David D. Bush; Westman, Champlin & Koehler, P.A.

(57) ABSTRACT

A multilayer antenna is provided, which includes a power supply portion generating a wave, a radiating portion, and a guide portion that makes it possible to guide the wave from the power supply portion to the radiating portion. The guide portion includes: at least two stacked guide layers having parallel planes and, for each pair of adjacent layers, a transition between the adjacent layers, including a reflector engaging with a slot-coupling. For at least one pair of adjacent layers, for which the guide portion includes a non-planar reflector, the slot-coupling includes a plurality of slots. Each slot includes a main body that is elongate along at least one axis. The slots are placed on at least one row and together form a pattern that extends along the reflector and has a shape that is dependent on the shape of the reflector.

10 Claims, 8 Drawing Sheets

(51) Int. Cl.

| | |
|---|---|
| ***H01Q 19/13*** | (2006.01) |
| ***H01Q 3/18*** | (2006.01) |
| ***H01Q 13/22*** | (2006.01) |
| ***H01Q 19/17*** | (2006.01) |
| ***H01Q 21/00*** | (2006.01) |
| ***H01Q 21/06*** | (2006.01) |

(56) References Cited

U.S. PATENT DOCUMENTS

| | | | | |
|---|---|---|---|---|
| 5,049,895 | A * | 9/1991 | Ito | H01Q 21/0012 343/771 |
| 5,357,260 | A * | 10/1994 | Roederer et al. | 343/754 |
| 5,661,498 | A * | 8/1997 | Goto | H01Q 21/064 343/770 |
| 6,049,311 | A * | 4/2000 | Alexanian | H01Q 3/22 343/700 MS |
| 6,396,440 | B1 * | 5/2002 | Chen | H01Q 21/0012 343/700 MS |
| 6,597,322 | B2 * | 7/2003 | Takenoshita | 343/771 |
| 6,980,169 | B2 * | 12/2005 | Honda | 343/775 |
| 2002/0101386 | A1 | 8/2002 | Takenoshita | |
| 2005/0156801 | A1 | 7/2005 | Honda | |
| 2006/0132374 | A1 | 6/2006 | Wang | |

OTHER PUBLICATIONS

English translation of the International Preliminary Report on Patentability and Written Opinion dated Oct. 4, 2011 for corresponding International Application No. PCT/EP2010/054060, filed Mar. 29, 2010.

W. Rotman, "Wide Angle Scanning with Microwave Double-Layer Pillboxes", IRE Transactions on Antennas and Propagation, vol. 6, No. 1, pp. 96-105, Jan. 1958.

W. Rotman, R.F. Turner, "Wide Angle Microwave Lens for Line Source Applications", IEEE Transactions on Antennas and Propagation, vol. 11, No. 6, pp. 623-632, Nov. 1956.

T. Teshirogi et al., "Dielectric Slab Based Leaky-Wave Antennas for Millimeter-Wave Applications", IEEE Antennas and Propagation Society International Symposium, 2001, vol. 1, pp. 346-349, Jul. 2001.

Mazzola et al., "Coupler-Type Bend for Pillbox Antennas", IEEE Transactions on Microwave Theory and Techniques, vol. 15, No. 8, pp. 462-468, Aug. 1967.

French Search Report dated Oct. 27, 2009 for corresponding French Application No. FR0952158, filed Apr. 2, 2009.

Sletten, "Reflector Antennas", Antenna Theory, R.E. Collin and F.J. Zucker, Eds. New York: McGraw-Hill, 1969, Part 2, Ch. 17.

Japanese Office Action and English Translation dated Nov. 22, 2013 from the Japanese Patent Office for corresponding Japanese Patent Application No. 2012-502610.

* cited by examiner

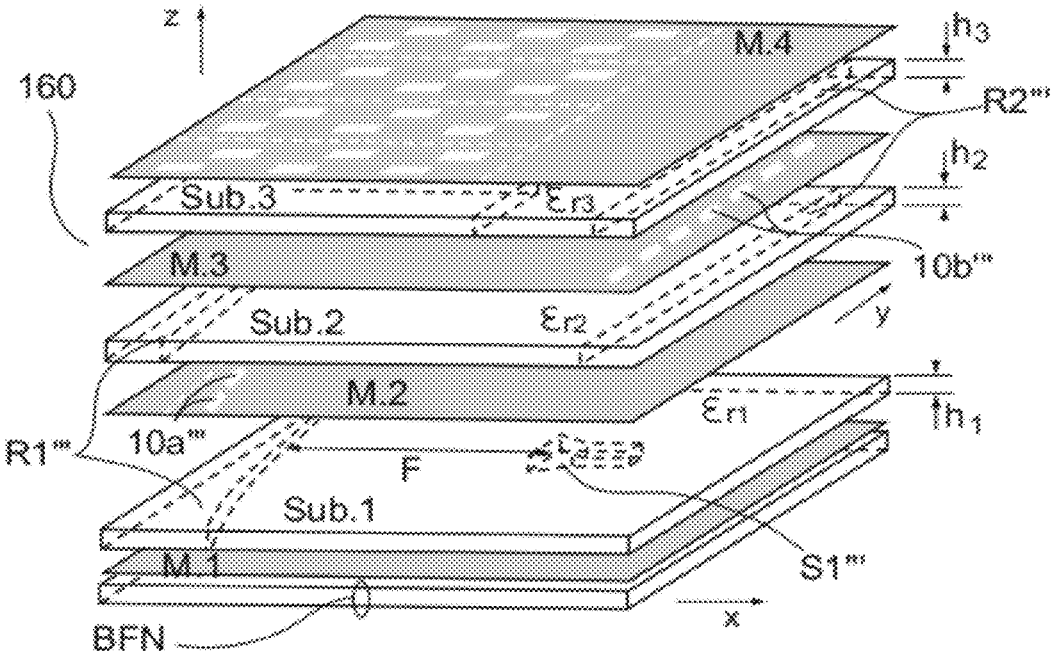
Fig. 16
Fig. 17A
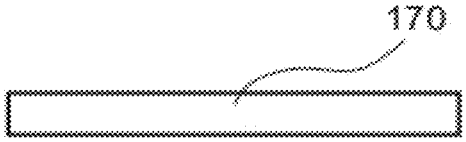
Fig. 17B
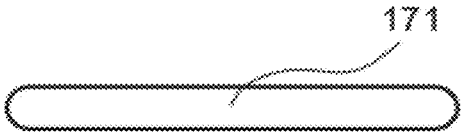
Fig. 17C
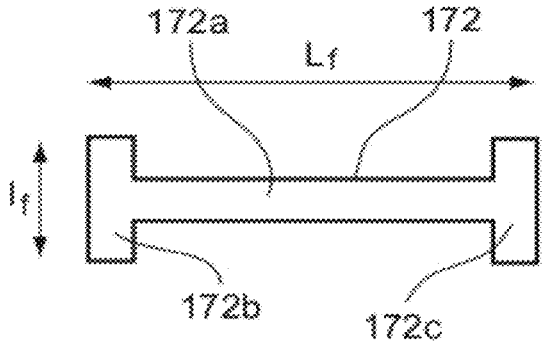

MULTILAYER PILLBOX TYPE PARALLEL-PLATE WAVEGUIDE ANTENNA AND CORRESPONDING ANTENNA SYSTEM

CROSS-REFERENCE TO RELATED APPLICATIONS

This Application is a Section 371 National Stage Application of International Application No. PCT/EP2010/054060, filed Mar. 29, 2010 and published as WO 2010/112443 on Oct. 7, 2010, not in English.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The field of the disclosure is that of multilayer parallel-plate waveguide antennas also called pillbox antennas or cheese antennas.

The disclosure has numerous applications, for example in:

- automobiles radars,
- communications between mobile platforms (cars, trucks, trains, boats etc) and satellites,
- communications between mobile platforms (high altitude platforms or HAPs, aircraft etc) and the earth (for example in the Ku, Ka and Q bands),
- terrestrial wireless communications (inside or outside buildings) with multiple-beam, beam-shaping and beam-reconfiguring capacities.

BACKGROUND OF THE DISCLOSURE

1. Context

In recent years, a great demand has emerged for the production of low-cost and high-performance antennas in the millimeter-wave range, especially for telecommunications, radar and monitoring applications.

Planar solutions, in the form of parallel-plate systems on a substrate, compatible with printed circuit board (PCB) technology, have been proposed and are considered to be the most promising in terms of performance, cost and compactness.

In parallel-plate single-layer waveguide antenna systems (also called monolayer systems), the energy provided by the source is confined between two metal plates situated on either side of a substrate layer and then guided towards a radiating part also included in this layer. This radiating part is generally formed by slotted waveguide arrays for example made with SIW (substrate integrated waveguides) or leaky-wave structures.

Conductive vertical walls, connecting the two metal plates, which behave like a mirror to the energy of the wave, enable the energy to be reflected or directed. These vertical walls generally have a parabolic profile in order to perform a collimation of the energy coming from the source. However, to prevent back-scattering towards the source, it is necessary to use a dual-reflector-based solution or a decentered configuration or else a dual-layer structure.

In the case of a dual-layer parallel-plate structure, the source and the radiating part are two different layers connected by a a plate with a 180° bend known as a "180° parallel-plate bend" with an often parabolic profile.

Such parallel-plate multilayer antennas are described for example in the following two scientific documents:

C. J. Sletten, "Reflector Antennas", Antenna theory, R. E. Collin and F. J. Zucker, Eds. New York: McGraw-Hill, 1969, Part. 2, Ch. 17, and W. Rotman, "Wide Angle Scanning With Microwave Double-Layer Pillboxes", IRE Transactions on Antennas and Propagation, Vol. 6, No. 1, pp. 96-105, January 1958.

The main advantage of these antennas is their modularity. Indeed, three parts corresponding to different functions can be distinguished: a feeding (source) part, a radiating part and a guiding part. The guiding part is used to guide the energy of the wave generated by the source from the feeding part up to the radiating part through the superimposed parallel-plate waveguide type layers. For each pair of adjacent layers, the guiding part has means of transition between these layers comprising a reflector cooperating with a slot.

Certain desired characteristics for antennas are now presented through the particular application of automobile radars.

The goal for the next generation of radars for automobile applications is to improve road safety through the efficient control of the various possible scenarios before the automobile (accidents, excessive proximity between cars, etc) and efficient reaction to these scenarios.

In front of a vehicle, there are two particularly well-defined action zones: a short radar range (SSR) and a long radar range (LRR) respectively extending from 0 to 30 m and from 30 to 200 m (typical values) from the front of the vehicle, which is the classic position of an embedded detection antenna.

From a viewpoint of antenna theory, this amounts to saying that performance in radiation and beam steering range (field of vision) of the antennas used for radar applications must be different in the SRR mode and in the LRR mode. Such antennas are called "reconfigurable radiation pattern antennas". Also, for reasons of aesthetics and aerodynamics, antennas of this type must be compact and light and must cost little to manufacture. Since it is impossible to integrate both an SRR antenna and a LRR antenna in one and the same vehicle, especially for reasons of cost and space requirement, it is necessary that this antenna should be reconfigurable, i.e. it should be capable of working in SRR mode and in LRR mode. To this end, a multi-beam, reconfigurable, planar and/or beam-steering antenna seems to be the most promising solution as shall be more amply described here below.

2. Technological Background

In this section, we shall describe several types of antennas that can be used for automobile applications.

A first well-known technique relies on the use of dielectric lenses. Commercial solutions already exist. These solutions are very attractive but remain bulky.

A second well-known technique consists of the use of Rotman lenses which are quasi-optical planar systems having three focal points as described in the following scientific document: W. Rotman, R. F. Turner, "Wide-angle microwave lens for line source applications", IEEE Transactions on Antennas and Propagation, Vol. 11, No. 6, pp. 623-632, November 1956. One major drawback of this second technique is the large size of the complete antenna system and its low modularity because all the parts (the feeding part, the guiding part and the radiating part) are made on one and the same substrate.

Also, the Rotman lens has large dimensions which mean that the overall size of the antenna cannot be reduced.

This structure is also limited in terms of number of input beams to achieve full beam-steering.

Finally, such a structure shows high insertion losses.

A third known technique pertains to a dual-layer parallel-plate (pillbox) antenna as presented in the following scientific document: T. Teshirogi, Y. Kawahara, A. Yamamoto, Y. Sekine, N. Baba, M. Kobayashi, "Dielectric Slab Based Leaky-Wave Antennas for Millimeter-Wave Applications", IEEE Antennas and Propagation Society International Symposium, 2001, Vol. 1, pp. 346-349, July 2001.

FIGS. 1 and 2 present views in perspective and in section respectively of an antenna according to this third known technique. It comprises a bottom layer 5 and a top layer 6. The bottom layer 5 is a parallel-plate structure comprising two metal plates 8, 9. The top layer 6 is also a parallel-plate structure comprising two metal plates 9, 4, one of which (referenced 9) is common to both layers and to both parallel-plate structures. The two layers 5, 6 are connected by means of transition comprising a reflector 2 (a 180° parallel-plate bend) with a parabolic profile and a single slot 7 extending along and throughout the length of the parabolic reflector 2. In the bottom layer 5, the feeding part is placed, comprising a single sectoral horn 1. In the top part 6, the radiating part 3 is placed. The means of transition (reflector 2 and single slot 7) enable the transfer of energy between the bottom layer 5 and the top layer 6 (i.e. from the horn 1 to the radiating part 3), the wavefront impinging on the parabolic reflector being a cylindrical wavefront.

The main drawbacks of this third known technique lie in the fact that the means of transition comprise a single slot, which does not enable an optimal transfer of energy (owing to the existence of resonance phenomena in a single slot) and is efficient only in a narrow angular range. The resolution is therefore not optimal.

Furthermore, the combined use (in the means of transition) of a parabolic reflector and a single slot do not make it possible, according to the document WO91/17586, to obtain a perfectly plane wavefront in the top layer (after reflection on the reflector) if the impinging wavefront of the bottom layer is a cylindrical wavefront (or more generally not plane).

Furthermore, this third known technique does not enable the use of several excitation sources since the horn extends directly up to the edge of the parabolic reflector (sectoral horn). No beam reconfiguration or beam steering is therefore possible.

A fourth known technique is a variant of the third known technique described here above. It is described in the following scientific document: V. Mazzola, J. E. Becker, "Coupler-Type Bend for Pillbox Antennas", IEEE Transactions on Microwave Theory and Techniques, Vol. 15, no. 8, pp. 462-468, August 1967>>).

In this variant, the single slot (included in the means of transition between the two layers) is replaced by a plurality of circular apertures, distributed in a triangular mesh (i.e. a mesh whose basic pattern is a triangle) extending along the reflector. Thus, the coupling performed by the means of transition is improved, the operating frequency band is wider and the angular range is also wider. It works in the E plane (electrical field parallel to the metal plates forming the parallel planes of the two layers).

One drawback of this fourth known technique is that it can work with only one polarization (horizontal polarization: the TE mode in parallel-plate waveguide or PPW). It therefore cannot work in double polarization.

Furthermore, like the third known technique, it does not enable the use of several excitation sources. No beam reconfiguration is therefore possible.

Another drawback of the fourth known technique is that the increase in efficiency of the transition is done at the cost of an increase of the coupling region (the number and size of the circular apertures included in the triangular mesh) and therefore ultimately an increase in the space requirement and cost of the antenna.

SUMMARY

In one particular embodiment of the invention, there is proposed a multilayer antenna comprising:

- a feeding part generating a wave;
- a radiating part;
- a guiding part enabling said wave to be guided from the feeding part to the radiating part, said guiding part comprising:
  - at least two parallel-plate guide type superimposed layers, and
  - for each pair of adjacent layers, means of transition between said adjacent layers, comprising a reflector cooperating with a means of coupling by slots, said antenna being such that, for at least one pair of adjacent layers for which the guiding part comprises a reflector of non-plane shape, the means of coupling by slots comprise a plurality of slots, each slot comprising a main body having a shape elongated along at least one axis, said plurality of slots being laid out in at least one row and together forming a pattern that extends along the reflector and has a shape that is a function of the shape of the reflector.

Thus, an embodiment of the invention relies on a wholly novel and inventive approach in which a reflector of a non-plane shape (for example of the parabolic type) is maintained and in which, in the means of transition between the two layers, the single slot of the third known solution is replaced:

- not by a plurality of circular apertures distributed in a triangular mesh extending throughout the length of the reflector (as in the known fourth technique), but
- by a plurality of slots (see here below the description of FIGS. 17A to 17E for the definition of the term "slot" in the context of an embodiment of the present invention, as well as for a few non-exhaustive examples of slots).

Thus, the resonance effects that appear in a continuous slot are reduced. The transfer of energy between two successive layers is thereby improved in a wide angular range and over a wide frequency band. In other words, an antenna is obtained showing optimized yield in terms of power transfer.

Furthermore, the combined use (in the means of transition) of a reflector with a non-plane shape (the impinging wavefront of the bottom layer is therefore a non-plane wavefront) and a plurality of slots makes it possible to obtain a perfectly plane wavefront in the top layer (after reflection on the reflector).

Furthermore, and as described in detail here below, the use of a plurality of slots makes it possible to provide an antenna that can work in double polarization. This also gives an antenna that can use several excitation sources and therefore one whose beam is reconfigurable.

In one particular embodiment, said plurality of slots is laid out in a single row.

Advantageously, each slot has a main body having a shape elongated along at least one axis substantially parallel or perpendicular to the reflector.

Thus, the coupling achieved by the plurality of slots is further improved.

In a first particular embodiment, at least certain slots have a main body possessing a shape elongated along only one axis.

Thus, the antenna can work in single polarization. FIGS. 17A to 17C, described in detail here below, illustrate a few non-exhaustive examples of slots that can be used in this first embodiment of the invention.

In a second particular embodiment, at least certain slots include a main body possessing a cross shape, said main body comprising a first arm having a shape elongated along a first axis and a second arm having a shape elongated along a second axis substantially perpendicular to the first axis.

Thus, as a result of these cross-shaped slots (i.e. where the main body is cross-shaped), the antenna can work in a double polarization mode. FIGS. 17D and 17E, described in detail here below, illustrate a few non-exhaustive examples of slots that can be used in this second embodiment of the invention.

It must be noted that in one alternative of this second embodiment, the plurality of cross-shaped slots can be replaced by a set of first slots comprising a main body with a shape elongated along a first axis and a set of second slots comprising a main body with a shape elongated along a second axis substantially perpendicular to the first axis.

Advantageously, the shape of the pattern formed together by said plurality of slots is substantially identical to that of the reflector.

It may be recalled that the reflector has a classic shape (parabola, ellipse, hyperbola, circle) or any other shape adapted to a specific need.

Advantageously, each slot of said plurality of slots has a length ranging from $0.25*\lambda_d$ to $0.5*\lambda_d$, and a width ranging from $0.1*\lambda_d$ to $0.2*\lambda_d$, with $\lambda_d$ being the wavelength in the parallel-plate guide type superimposed layers, at the operating frequency of the antenna.

Thus, the length and the width of the slots are parameters which can be brought into play, for each slot, to easily optimize the efficiency of the transition in which the slots participate.

According to an advantageous characteristic, each slot of said plurality of slots has a length ranging from $0.3*\lambda_d$ to $0.5*\lambda_d$, with $\lambda_d$ being the wavelength in the parallel-plate guide type superimposed layers, at the operating frequency of the antenna Thus, the distance of each slot from reflector is a parameter which can be brought into play, for each slot, to easily optimize the efficiency of the transition in which the slots participate.

Advantageously, the distance between two adjacent slots of said plurality of slots ranges from $0.02*\lambda_d$ to $0.1*\lambda_d$, with $\lambda_d$ being the wavelength in the parallel-plate guide type superimposed layers at the working frequency of the antenna.

Thus, the distance between two adjacent slots is a parameter which can be brought into play, for each slot, to easily optimize the efficiency of the transition in which the slots participate.

According to one advantageous characteristic, said feeding part comprises at least two sources that are mutually interlaced, physically or electrically.

Thus, it is possible to have a uniform beam width on a wider angular range, determined by the position of said interlaced sources.

In one alternative embodiment, said feeding part has at least one source and one first means for mechanically shifting said at least one source in a plane parallel to the parallel-plate guide type superimposed layers.

Thus, a beam steering can be obtained mechanically. The notion of beam steering is described in detail here below with reference to FIG. 18.

According to one advantageous characteristic, said feeding part comprises at least two sources and means for the selective feeding of said at least two sources.

Thus, it is possible to obtain a beam-shape changing and/or a beam sweeping operation (changing of the axis of aim) by changing, in the course of time, the source or the sources that are effectively fed. The notions of beam-shape changing and beam sweeping are described in detail here below with reference to FIG. 18.

According to another embodiment of the invention, an antenna system is proposed comprising a multilayer antenna according to one of the above-mentioned embodiments and a second means for mechanically shifting said antenna.

Thus, it is possible to carry out the 3D reconfiguration (beam-shape changing and/or beam sweeping). Indeed, the multilayer antenna radiates essentially in a plane (see FIG. 18) which the second shifting means make possible to shift.

According to another embodiment of the invention, an antenna system is proposed comprising a multilayer antenna according to one of the above embodiments (i.e. comprising: a first feeding part generating a first wave; a radiating part; and a guiding part enabling said first wave to be guided from the first feeding part to the radiating part, said guiding part including at least two parallel-plate guide type superimposed layers, and for each pair of adjacent layers, first means of transition between said adjacent layers, comprising a first reflector cooperating with a first means of coupling by slots). The antenna system also comprises a second feeding part generating a second wave. Said guiding part also enables said second wave to be guided from the second feeding part up to the radiating part, said guiding part moreover comprising, for each pair of adjacent layers, second means of transition between said adjacent parts comprising a second reflector cooperating with a second means of coupling by slots, said second means of transition being offset by 90° relatively to said first means of transition. For at least one pair of adjacent layers for which the guiding part includes a reflector of non-plane shape, the first means of coupling by slots comprise a plurality of first slots, each first slot possessing a shape elongated along at least one axis, said plurality of first slots being positioned on at least one row and together forming a pattern that extends along the first reflector and possesses a shape that is a function of the shape of the first reflector. For at least one pair of adjacent layers for which the guiding part comprises a reflector of non-plane shape, the second means of coupling by slots comprises a plurality of second slots, each second slot possessing a shape elongated along at least one axis, said plurality of second slots being positioned on at least one row and together forming a pattern that extends along the second reflector and has a shape that is a function of the shape of the second reflector.

Thus, it is possible to carry out a 3D reconfiguration (beam-shape changing and/or beam steering) in a way that is simple, reliable, compact and low-cost.

BRIEF DESCRIPTION OF THE DRAWINGS

Other objects, features and advantages shall appear from the following description given by way of a non-exhaustive example, and from the appended drawings, of which:

FIG. 16 is a view in perspective of a three-layer antenna according to a third particular embodiment of the invention;

DETAILED DESCRIPTION OF ILLUSTRATIVE EMBODIMENTS

We shall strive more particularly here below in the document to describe the problems and issues existing in the field of antennas for latest-generation automobile radars that the inventors of the present patent application have faced. The invention is of course not restricted to this particular field of application but is of value for any technique that has to cope with a proximate or similar set of problems and issues.

It must also be noted that, in all the figures of the present document, the identical elements are designated by same numerical references.

Figure 1:
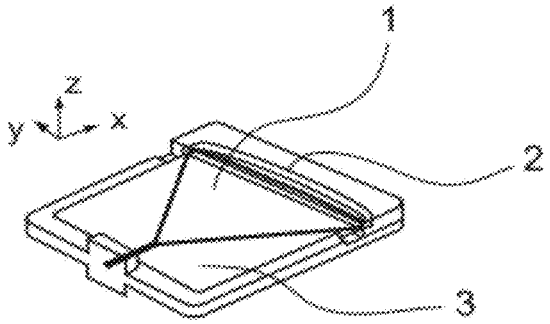
FIGS. 1 and 2 are views in perspective and in section respectively of an antenna according to the prior-art technique of Teshirogi and al.
Figure 2:
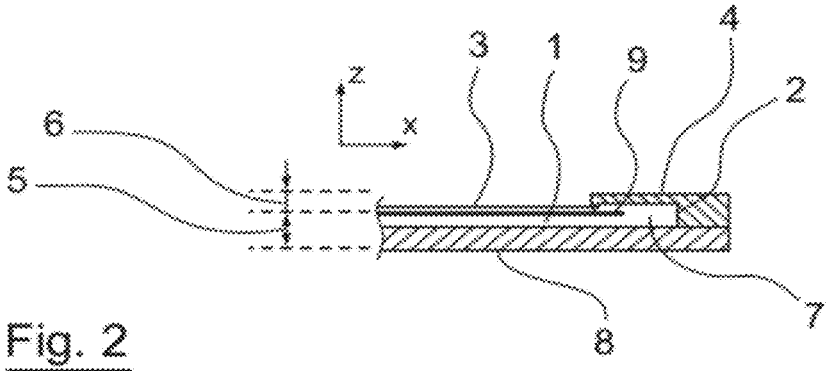
Figure 3:
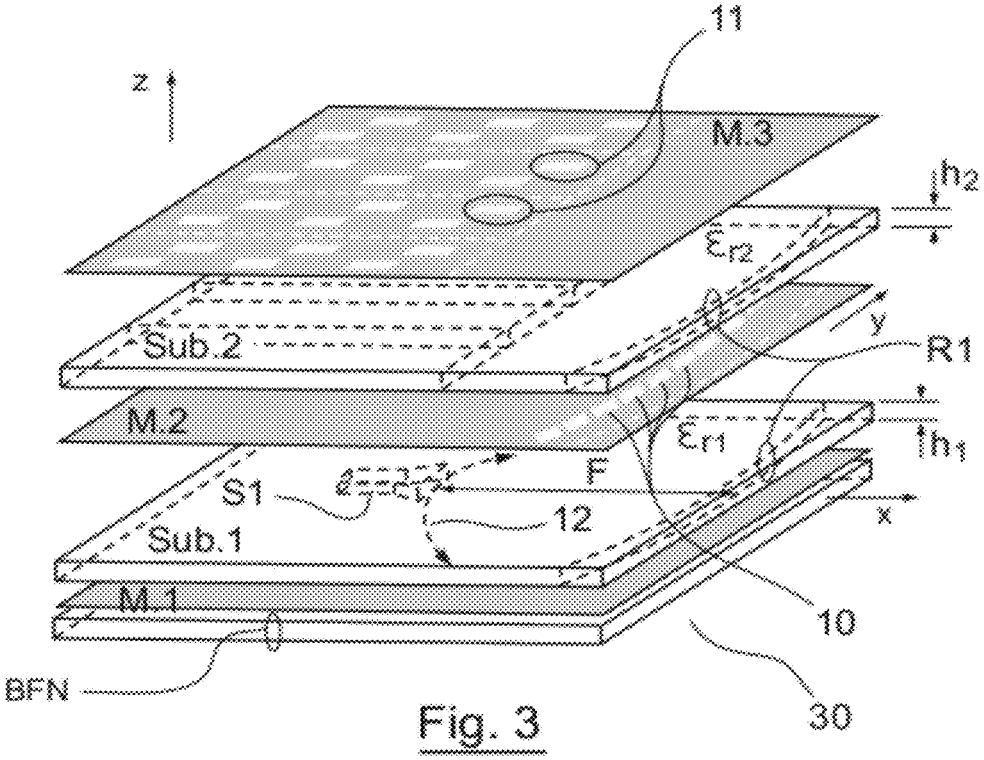
FIGS. 3 and 4 are views in perspective and in section respectively of a two-layer antenna according to one particular embodiment of the invention.
Figure 4:
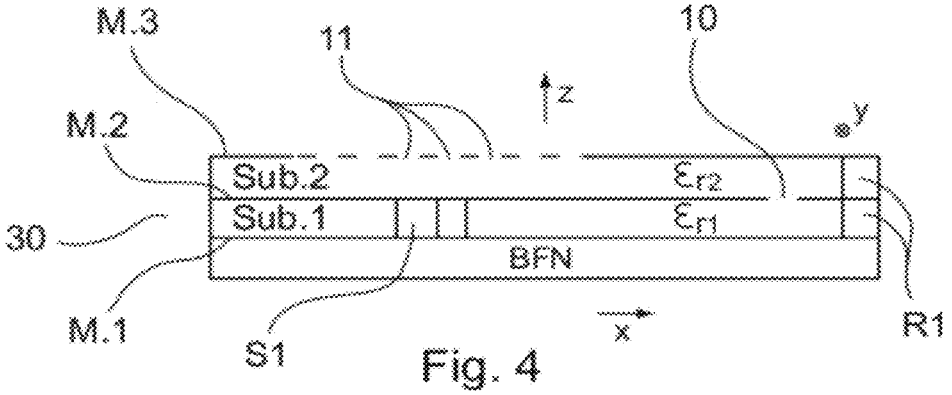

Referring now to FIGS. 3 and 4, we present a two-layer antenna 30 according to one particular embodiment of the invention. Such an antenna may be used for example in radars for automobile applications.

In this embodiment, the antenna 30 has a guiding part with two parallel-plate layers having a metal plate M.2 in common. More specifically, the guiding part comprises:

- a first parallel-plate layer itself comprising two metal plates M.1, M.2 situated on either side of a dielectric substrate layer Sub.1;
- a second parallel-plate layer itself comprising two metal plates M.2, M.3 situated on either side of a dielectric substrate layer Sub.2.

The height and permittivity of the two substrate layers Sub.1, Sub.2 are chosen preferably to comply with the following relationship:

$$h2=(\sqrt{\in_{r2}}/\sqrt{\in_{r1}})*h1 \quad \text{(equation 1)}$$

where h2 and h1 are respectively the heights of the two substrate layers Sub.2 and Sub.1, and $\in_{r1}$ and $\in_{r2}$ are respectively the permittivity values of the two substrate layers Sub.1 and Sub.2.

For the sake of simplification, here below in the description, it is considered that:

$$h1=h2, \text{ and } \in_{r1}=\in_{r2} \text{ with } (\in_{r1}, \in_{r2}\geq 1).$$

The two layers of substrates are coupled by an optical means of transition comprising a parabolic reflector R1 and a plurality of coupling slots 10 made in the common metal plate M.2.

The parabolic reflector R1 extends from the metal plate M.1 to the metal plate M.3. Other reflector profiles (canonical or of optimized arbitrary shape) can be used (see description of FIG. 6 here below).

In this embodiment, each coupling slot 10 has a rectangular shape and extends along an axis substantially parallel to the reflector. The plurality of coupling slots 10 is positioned in a row and the slots together form a parabolic pattern which stretches along the parabolic reflector. The pattern formed by all the coupling slots is for example the geometrical locus formed by the geometrical centers of the slots (such as for example the one given by the equation No. 2 given further below; this equation is not exhaustive).

Other shapes of coupling slots can of course be used without departing from the framework of the present invention.

Figure 17D:
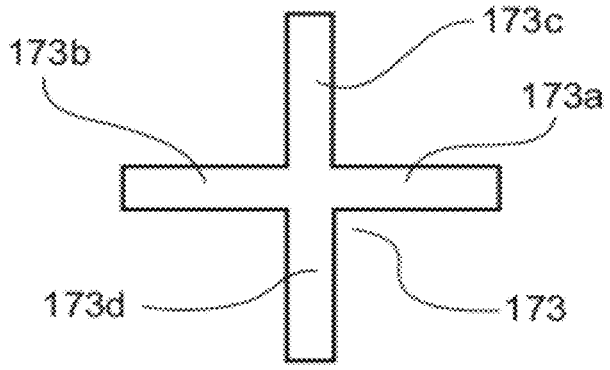
FIGS. 17D and 17E illustrate a few non-exhaustive examples of coupling slots that can be used in an antenna according to the invention.
Figure 17E:
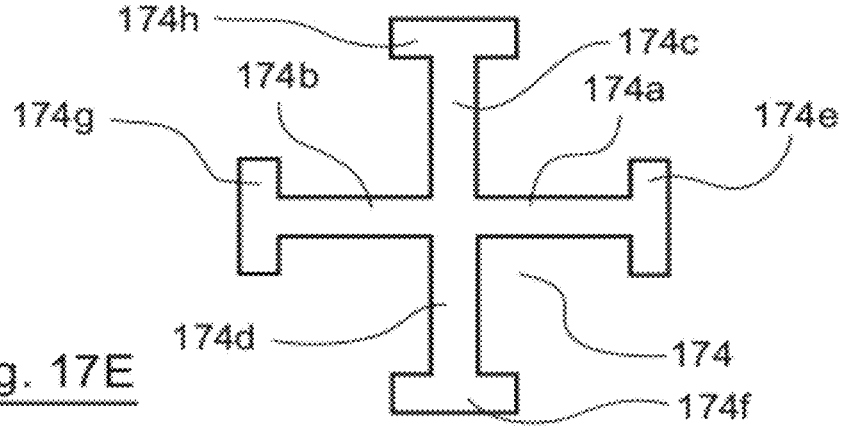

Referring now to FIGS. 17D and 17E, we present a few non-exhaustive examples of coupling slots that can be used in an antenna according to an embodiment of the invention.

FIG. 17A presents a rectangular slot 170 (i.e. a slot comprising a main body with a rectangular shape and therefore elongated along an axis).

FIG. 17B presents a slot 171 comprising a main body possessing a shape elongated along an axis. This slot 171 is distinguished from that of FIG. 17A in that its ends are rounded.

FIG. 17C presents an H-shaped slot (also called a dog bone slot) 172 comprising a main body 172*a* having a shape elongated along an axis and two duplicated ends 172*b*, 172*c*. Each duplicated end makes it possible to reduce the physical length of the slot (in view of the goal of antenna compactness) but not its electrical length. Typically, the length $l_f$ of each duplicated end 172*b*, 172*c* is far smaller than the length $L_f$ of the main body 172*a* (for example in a ratio of 3 to 4). In one variant (not shown), the duplicated ends of the H-shaped slot are rounded.

FIG. 17D presents a single cross-shaped slot 173. It has a main body comprising a first arm 173*a*, 173*b* having a shape elongated along a first axis and a second arm 173*c*, 173*d* having a shape elongated along a second axis substantially perpendicular to the first axis. In one variant (not shown), the ends of the single cross-shaped slot are rounded.

FIG. 17E presents a slot 174 in the shape of a Jerusalem cross. It has a main body, comprising a first arm 174*a*, 174*b*, having a shape elongated along a first axis and a second arm 174*c*, 174*d* having a shape elongated along a second axis substantially perpendicular to the first axis. Each end 174*e*, 174*f*, 174*g*, 174*h* of the arms is duplicated. This makes it possible to reduce the physical length of the slot (in view of the goal of antenna compactness) but not its electrical length. Typically, the length of each duplicated end is far smaller than the length of the arm (of the main body) at the end of which it is situated (for example in a ratio of 4 to 3). In one variant (not shown), the ends of the slot of Jerusalem cross shape are rounded.

As described in detail here below with reference to FIG. 8, the cross-shaped slots enable the antenna to operate in double polarization.

Resuming now the description of FIGS. 3 and 4, the antenna 30 also comprises a feeding part comprising a source S1 placed in the substrate layer Sub.1. As described in detail here below, it is possible to use several sources (see FIGS. 5 and 9) or means for mechanically moving a single source to obtain a shift in a plane parallel to the parallel-plate guide type superimposed layers (the path of the shift obtained is shown in FIG. 3 by the arrow shown in dashes and referenced 12).

The antenna also has a radiating part which is made on the substrate layer Sub.2 comprising a plurality of radiating slots 11 made in the upper metal plate M.3.

FIGS. 3 and 4 also show a beam-forming network (BFN) substrate. This BFN substrate enables the shaping of the beam by excitation or non-excitation of the source or sources, for example by means of active components (diodes or EMS components for example).

The working of this antenna is as follows: the energy of the wave generated by the source S1 is guided by the first parallel-plate layer (metal plate M.1, M.2 and substrate layer Sub.1). As a result of the optical transition (reflector R1 with a plurality of coupling slots 10), this energy is transferred to the second parallel-plate layer (metal plates M.2, M.3 and substrate layer Sub.2) where finally it is radiated by the radiating part (plurality of radiating slots 11).

Figure 18:
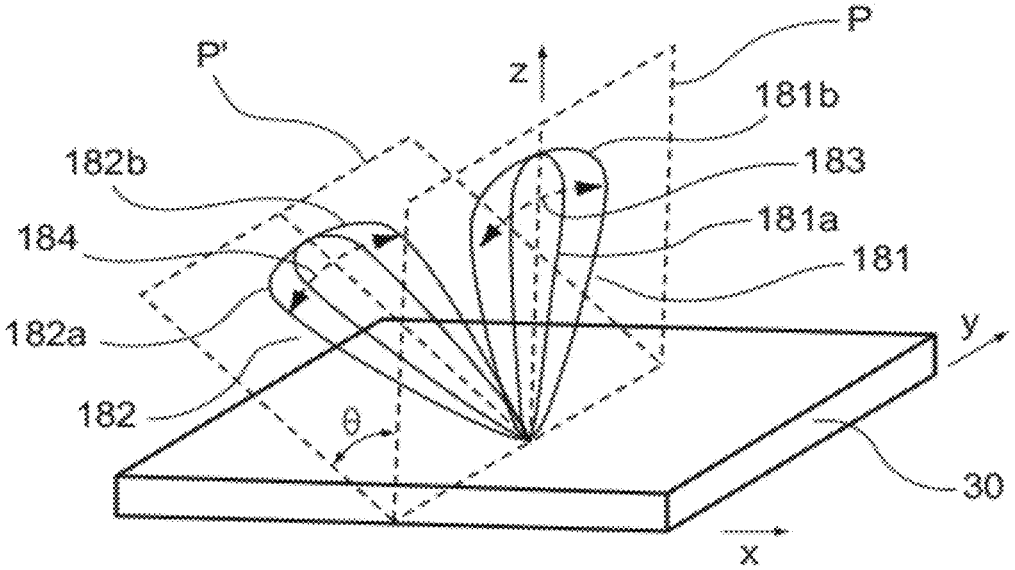
FIG. 18 illustrates the notion of a main radiation plane of the antenna of FIGS. 3 and 4 as well as notions of beam-shape changing and beam-steering.

FIG. 18 illustrates the main radiation of the antenna 30 of FIGS. 3 and 4. It is assumed that the mode used is the TEM mode in which the electrical field is oriented along the axis Z. Depending on the type of radiating part used, we obtain:

- either a main radiation pattern 181 situated in the plane YZ (the plane orthogonal to the superimposed layers of the parallel-plate type guide), referenced P in FIG. 18;
- or a main radiation pattern 182 situated in a plane referenced P' in FIG. 18 which is inclined by an angle θ relatively to the plane YZ.

Whatever the plane, P or P', in which it is located, the main radiation pattern includes for example a major lobe (this is especially the case if only one source is fed). As described in detail here below, in certain particular embodiments of the antenna, it is possible to:

- change the shape of the main radiation pattern (by modifying the number of fed sources). To illustrate this change of shape in FIG. 18, we have shown two possible beams, one narrow beam 181*a*, 182*a* and one wide beam 181*b*, 182*b* for each of the planes P and P'; and/or
- perform a beam-sweeping operation (either by modifying the fed sources or through a means for mechanically shifting the source or sources). This feeding is illustrated in FIG. 18 by two arrows referenced 183 and 184.

It must be noted that these notions of beam-shape changing and beam sweeping apply to all the structures according to different embodiments of the invention.

In the example of an antenna 30 of FIGS. 3 and 4, because of the parabolic profile of the reflector R1 and for optical reasons, the source S1 and the radiating part 11 are placed along and immediately after the focal plane of the parabolic reflector (i.e. at the focal distance) even if, especially for the radiating part, other positions are possible (especially to reduce the surface area of the antenna) by suitably verifying the leading phase of the wave reflected by the parabolic reflector. The focal difference is referenced F in FIG. 3.

It must be noted that although the 76-81 GHz frequency band is generally used for an automobile radar application, all the results presented here below are obtained at the operating frequency $f_0$=24,15 GHz without however affecting the general principle of embodiments of the present invention. All the concepts presented here can therefore also be applied in a range of other frequencies.

A more detailed description is given here below of the feeding part. It is situated in the focal plane F (or in the vicinity of this focal plane) of the reflector R1 of the means of transition. It includes either a single source (the case of the source S1 in FIG. 3) or several sources. The source or sources are used to generate a TEM (transverse electromagnetic) wave or a TE (transverse electric) wave or else both waves. The TEM wave has an electrical field oriented along the Z axis while the TE wave has an electrical field oriented along the Y axis. The TEM mode is more particularly described here below.

According to one embodiment of the invention, the elementary source or sources are H sectoral horns (or integrated H-plane sectoral horns). Such a horn shape is particularly advantageous when several sources are used to generate one or more beams and thus enable the beams to be reconfigured. However, it must be noted that other well-known shapes of sources can be used (monopole networks, Perot-Fabry sources with interlacing, etc).

Figure 5:
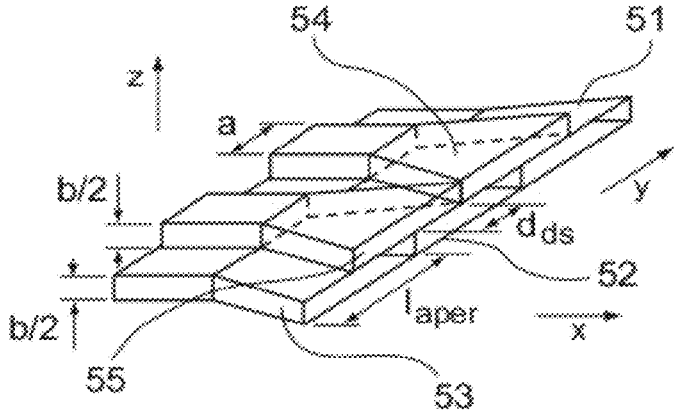
FIG. 5 is a schematic view in perspective of a physical interlacing of sources included in the feeding part, according to one particular embodiment of the invention.

As shown in FIG. 5, where several sources are used, an advantageous solution in terms of compactness and efficiency of illumination of the reflector R1 consists in carrying out a physical interlacing of sources. In this example, the unit sources 51 to 55 are stacked on two levels, along the axis Z (a greater number of levels can of course be implemented). The sources of one and the same level have their rectangular apertures, of a length $l_{aper}$, aligned along the axis Y. The sources of a level are offset by a distance $d_{ds}$ relatively to the other level. In this example we have: $d_{ds}=0.5*l_{aper}$ (i.e. a 50% overlap between apertures of two adjacent horns). Such an arrangement of the sources thus enables a wide range of angles to be covered. However, other configurations are also possible.

Figure 9:
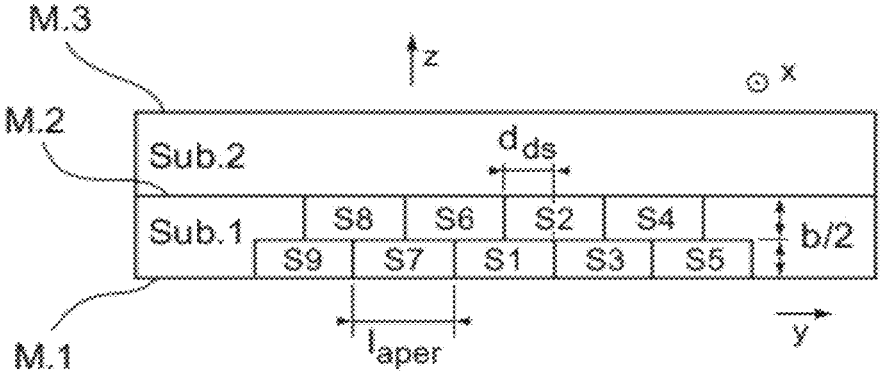
FIG. 9 is a view in section of a two-layer antenna according to one particular embodiment of the invention, showing a set of physically interlaced sources.

FIG. 9 is a view in section of an antenna with two layers according to one particular embodiment of the invention, showing a set of sources physically interlaced on two levels. In this example, nine sources are used. They are distributed as follows (following the order from left to right in FIG. 9): on the first level, the sources S9, S7, S1, S3 and S5; and on the second level the sources S8, S6, S2 and S4. As compared with the sources of the first level, the sources of the second level are offset rightwards by a half-length of horn aperture.

We now present the guiding part in greater detail.

Figure 6:
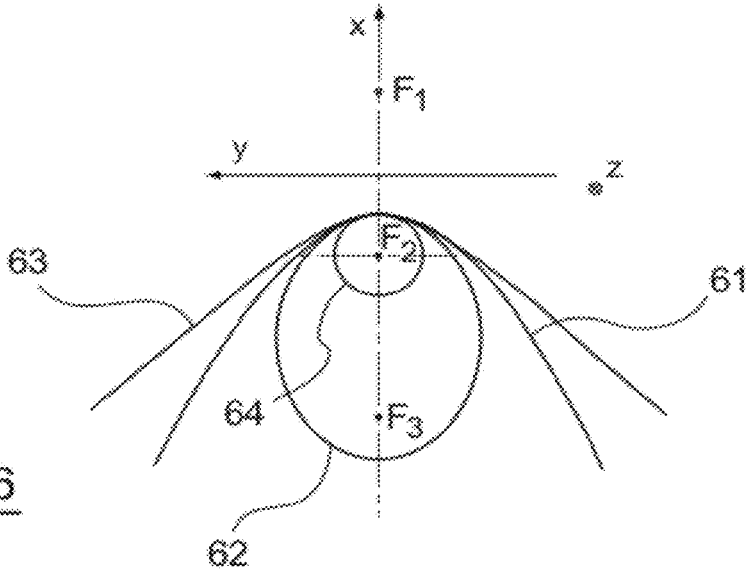
FIG. 6 illustrates different possible profiles for the reflector included in the means of transition between two adjacent layers.

FIG. 6 presents different possible profiles for the reflector R1 included in the means of transition between the first parallel-plate layer (metal plates M.1, M.1 and substrate layer Sub.1) and the second parallel-plate layer (metal plates M.2, M.3 and substrate layer Sub.2). These different profiles are a hyperbolic profile 63, an elliptic profile 62, a parabolic profile 61 and a circular profile 64. Other optimized arbitrary shapes can of course be used. In general, the profile of the reflector depends on the wave profile which must arrive in the second parallel-plate layer in accordance with optical laws. The profile most commonly used for pillbox type antennas is the parabolic profile 61. Indeed, in this case, the energy coming from the focal point F2 will be reflected into the second parallel-plate layer, as a planar wave and concentrated and directed towards the radiating part which is usually a planar network.

In the examples shown, the pattern formed by all the coupling slots has an identical shape (or substantially identical shape) to that of the reflector along which these slots are situated.

Figure 7:
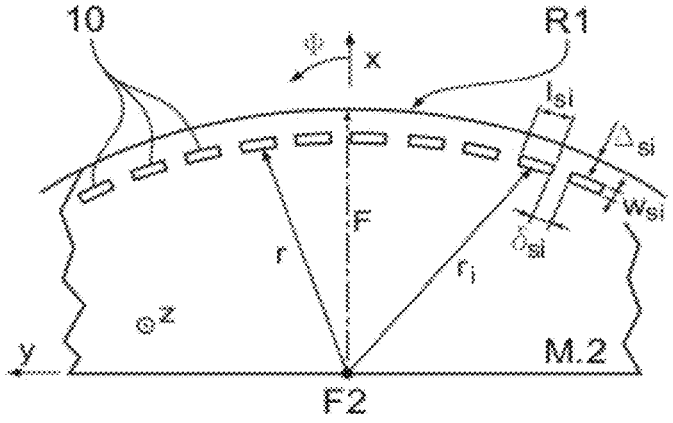
FIG. 7 is a schematic view of a plurality of slots cooperating with a parabolic reflector in a first particular embodiment of the means of transition between two adjacent layers, for operation in single polarization.

FIG. 7 is a schematic view of a plurality of coupling slots 10 working together with a parabolic reflector R1 in a first particular embodiment of the means of transition between two adjacent layers, for operation in single polarization.

As in FIG. 3, each coupling slot 10 has a rectangular shape along an axis substantially parallel to the reflector. The plurality of coupling slots 10 are laid out on a row and together form a parabolic pattern that extends along the parabolic reflector. Other slot shapes that are not necessarily rectangular can be used (see the description of FIGS. 17A to 17C).

The performance of these optical means of transition (in terms of transfer of energy to the second parallel-plate layer and the cancellation of the reflected wave which comes from the reflector to the source) can be increased by playing on the dimensions (length $l_{si}$ and width $w_{si}$) and the position ($r_{si}$) of each $i^{th}$ coupling slot.

Thus the $i^{th}$ coupling slot (within the row comprising all the coupling slots) occupies a position for which one of the cylindrical coordinates is defined by the following relationship:

$$r_i=(2F/1+\cos\phi)-\Delta_{si} \quad \text{(equation 2)}$$

where F is the focal distance of the parabolic profile of the reflector R1, $r_i$ and $\phi$ are the classic cylindrical coordinates of the centre of the $i^{th}$ slot, and $\Delta_{si}$ is the distance between the centre of the $i^{th}$ slot and the parabolic reflector.

According to one particular embodiment of the invention, the following conditions are verified:

$$0.25*\lambda_d<l_{si}<0.5*\lambda_d;$$

$$0.1*\lambda_d<w_{si}<0.2*\lambda_d; \text{ and}$$

$$0.3*\lambda_d<\Delta_{si}<0.5*\lambda_d.$$

In these formulae, $\lambda_d$ is the wavelength in the dielectric (i.e. in the parallel-plate guide type superimposed layers) at the working frequency of the antenna.

The number of slots is chosen so that the space $\delta_{si}$ between two adjacent slots complies with the condition: $0.02*\lambda_d<\delta_{si}<0.1*\lambda_d$.

In this example, the symmetry of the structure along the plane xz is also maintained. However, a non-symmetrical distribution of the slots can also be considered depending on the type of beam to be radiated by the antenna.

This configuration of FIG. 7 enables solely radiation in single polarization (vertical polarization with the electrical field along the Z axis). But it is also possible to radiate a double polarization as described in greater detail here below (see FIG. 8).

In accordance with the simulation, the use of a coupling means of this kind comprising a plurality of coupling slots makes it possible to eliminate the reflections of the wave during its interaction with the coupling means. Thus, the transfer of power is optimized (over a wide range of angles and frequencies) between the first and second layers.

Also, the use of a plurality of coupling slots eliminates the undesirable effects of resonance as classically encountered for a coupling means by a continuous single slot.

Figure 8:
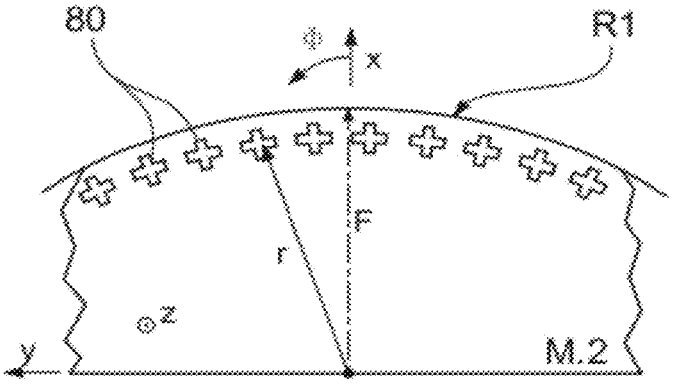
FIG. 8 is a schematic view of a plurality of slots cooperating with a parabolic reflector, in a second particular embodiment of the means of transition between two adjacent layers, for operation in double polarization.

FIG. 8 is a schematic view of a plurality of slots cooperating with a parabolic reflector in a second particular embodiment of the means of transition between two adjacent layers for an operation in double polarization.

Here above, and especially in the example of FIG. 3 (antenna working in single polarization), the mode used is the TEM mode in which the electrical field is oriented along the axis Z. However, the same considerations as those made here above for the means of transition can be repeated for a TE mode in which the electrical field is oriented along the axis Y. The only variation of the optical means of transition will be a substantially 90° rotation of the coupling slots made in the metal plate M.2 common to the two parallel-plate layers (other rotation angles could be chosen, for example a cross rotated by 45°).

Thus, to work in bi-polarization mode in the antenna of FIG. 8, each coupling slot is a cross-shaped slot 80 (see the description of FIGS. 17D and 17E), corresponding to the combination of two perpendicular slots. In this example, the two slots combined to form a cross are identical, but they can also be different. According to one variant, each cross-shaped slot is replaced by two perpendicular slots spaced out relatively to each other.

The fact that the coupling means are capable of working in double polarization gives another degree of freedom, in terms of both operation and reconfigurability of the antenna, as described in detail here below.

It must be noted that, once a double polarization operation is possible, all the other polarizations are also possible, such as for example a circular polarization.

It may also be recalled that two types of radiation can be obtained depending on the embodiments of the parallel-plate multilayer antennas:

- a single-beam radiation if the antenna includes a single source (the case of FIGS. 3 and 4 already described here above);
- a multibeam radiation if the antenna has several sources (the case of FIGS. 5 and 9 already described here above).

Here below, we discuss various aspects related to the beam reconfiguration at output of the antenna:

- 2D beam reconfiguration or beam sweeping in a first plane (in which the main radiation pattern is situated), with presentation of an electronic solution and a mechanical solution. This first plane (called a plane P or P' in FIG. 18) is the plane of the road in an automobile application;
- Control of beam width in a second plane, orthogonal to the first plane P, P' (this second plane is the plane orthogonal to the road, also called the elevation plane, in an automobile application) with a presentation of several solutions; and
- 3D beam reconfiguration or sweeping with presentation of an electronic solution and a mechanical solution.

As described here above, the next-generation automobile radars have to be compatible with the two modes namely SRR (short radar range, with wide beam) and LRR (long radar range, with narrow beam) and should achieve this through the use of only one antenna.

To obtain a 2D beam reconfiguration or scanning in the plane of the road, i.e. so that one and the same antenna can work in both the SRR and the LRR modes, one solution is that of adding, whether in phase or not, several LRR type narrow beams in order to cover the angular field associated with the SRR mode, especially because an SRR wide beam is a combination of LRR narrow beams.

Figure 10:
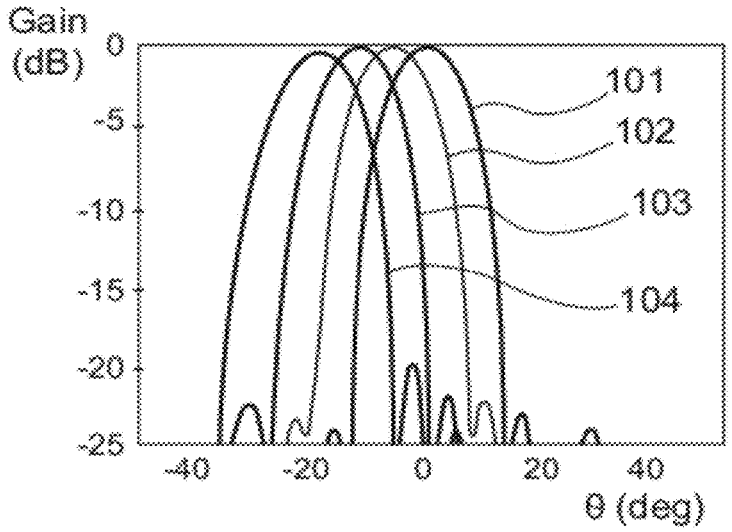
FIG. 10 shows four radiation patterns obtained with the antenna of FIG. 9, for four different feeding configurations (each feeding configuration corresponding to the activation of three proximate sources)

This concept is illustrated in FIG. 10 which has four radiation patterns 101 to 104 obtained with the antenna of FIG. 5 for four different feeding configurations (each feeding configuration corresponds to the activation of three proximate sources, respectively S6/S1/S2, S1/S2/S3, S2/S3/S4 and S3/S4/S5).

For each configuration, the beam obtained has a beam width of 14° (against 6° for a single source) and a level of minor lobes SLL smaller than −20 dB. It is possible to carry out a sweeping operation in passing from one of these configurations to the other (just as it is possible to carry out a scanning by activating the sources one by one).

The basic concept illustrated in FIG. 10 can be extended to beam shaping. For example, another solution is to feed the sources of FIG. 9 successively to modify the shape of the beam and thus be able to widen the angular range of the antenna for one and the same beam. It is also possible in this technique to create two different beams pointing in two different directions.

To obtain a 2D beam reconfiguration or sweeping in the plane of the road, the electronic solution described here above (and illustrated by FIG. 10) can find particular application when high sweeping speed is needed. However, in certain applications such as telecommunications between vehicles or base stations, slow sweeping speeds are accepted and it is possible to use a mechanical solution to obtain a 2D beam reconfiguration or sweeping.

This mechanical solution which has already been referred to here above in the description of FIG. 3 consists of the use of means for mechanically shifting the source in a plane parallel to parallel-plate guide type superimposed layers. In FIG. 3, the arrow referenced 12 illustrates the path of shift of the source S1.

We now present several solutions to control the beam width in the elevation plane (the plane orthogonal to the route in an automobile application).

The SRR and LRR modes require different performance characteristics also in the elevation plane. In this case, no sweeping is required but the beam width in LRR mode is typically (but not necessarily) half of the width in SRR mode.

Since the beam width in the elevation plane depends on the size of the antenna along the axis X, it means that the size of the beam in LRR mode should be twice that of the beam in SRR mode. In terms of reconfiguration, this means being capable of increasing or reducing the size along the axis X automatically. From an antenna viewpoint, this can be done in several ways, for example by using shunt diodes along the aperture (see FIG. 11), a discrimination of polarization (see FIG. 12) or again several antennas in SRR mode (for example two juxtaposed antennas without any angular offset between them).

The first two approaches are described in detail here below in the case of a radiating part containing a network of radiating slots but it is clear that these approaches can be used in other configurations. For the sake of simplification, only the radiating part is considered, while the feeding and guiding parts are for example those already described here above.

Figure 11:
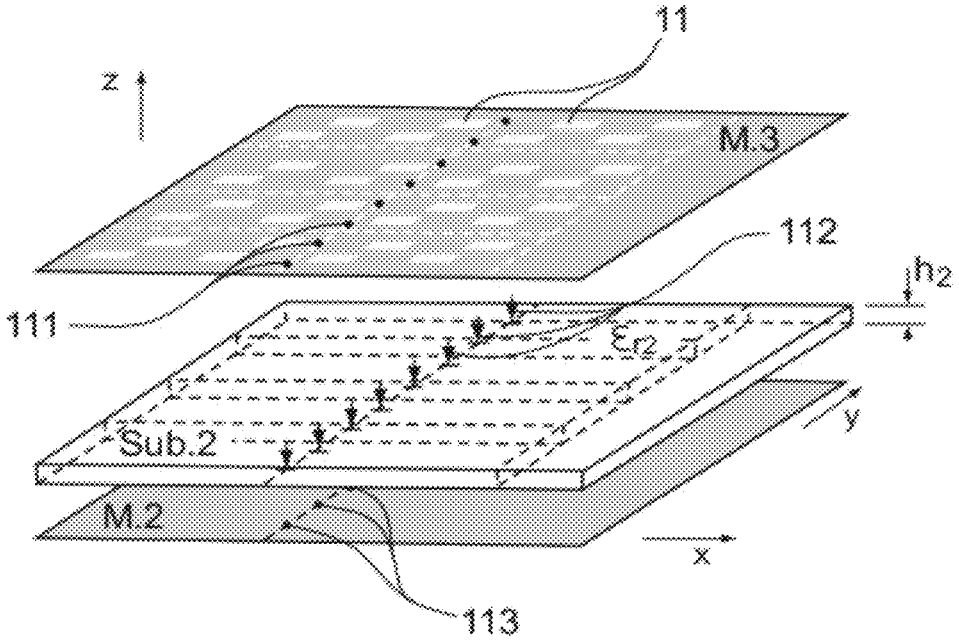
FIG. 11 is a partial view in perspective of a two-layer antenna according to one particular embodiment of the invention, comprising first means of reconfiguring the radiating part, based on the use of diodes or shorted loads (shunts)

FIG. 11 shows the integration of the shunt diodes 112 (or shunt loads in one variant) beneath the radiating part (along a line intersecting the radiating part area in which the radiating slots 11 are located), enabling connections 111 and 113 made on the metal plates M.3 and M.2 to be connected. These diodes are activated (activation means not shown in FIG. 11) for operation in SRR mode, in order to reduce the radiating part by half in shorting or absorbing the energy that arrives.

Figure 12:
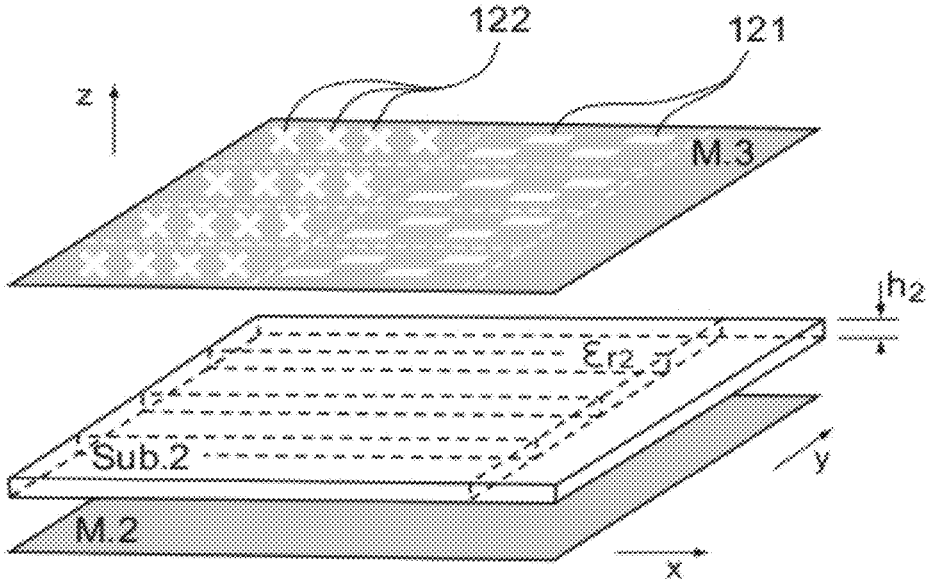
FIG. 12 is a partial view in perspective of a two-layer antenna according to one particular embodiment of the invention, comprising second means for reconfiguring the radiating part, based on the use of two sets of slots in the radiating part.

In FIG. 12, the radiating part is designed to respond to different polarizations for the LRR and SRR modes. This is done by using two sorts of radiating slots: single slots 121 (along one axis) and cross-shaped slots 122 (along two perpendicular axes). The former can radiate only if they are fed with an electrical field along the axis Z (TEM). The latter can radiate like the former but also if fed with an electrical field along the axis Y (TE). Thus, the cross-shaped slots work in both modes LRR and SRR while the single slots work only in the LRR mode. This approach is possible if the means of transition (reflector and coupling slots) can work in double polarization. This approach requires no control electronics, the discrimination being with respect to radiation.

We now present two solutions successively (the former being a mechanical solution and the latter an electronic solution) to enable a 3D beam reconfiguration or sweeping. The telecommunications applications usually require 3D sweeping within a predefined cone. In this case, the antenna system must be capable of making the beam sweep over 360° in one plane, and in a smaller angular range in the other plane.

The mechanical solution for 3D sweeping relies on either of the 2D sweeping solutions proposed here above (one mechanical and the other electronic). Indeed, these solutions must be adopted to cover the smallest angular range (sweeping in a first plane referenced P or P' in FIG. 18). For example, by adding a means for mechanically shifting the entire antenna in the plane xy (the plane parallel to the parallel-plate guide type superimposed layer), we obtain a rotation of the main radiation plane (plane P or P', FIG. 18) in which the antenna radiates mainly.

Figure 13:
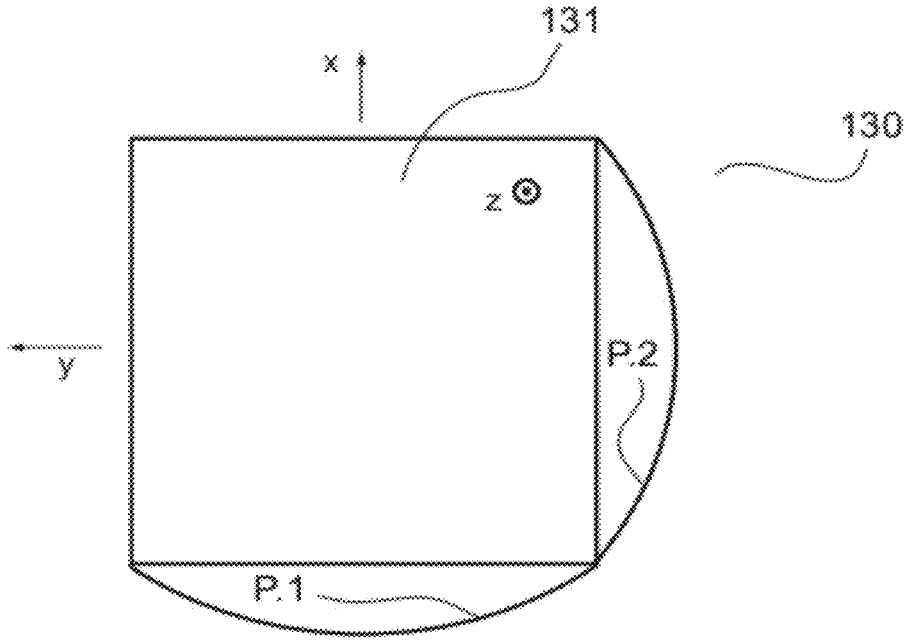
FIG. 13 is a top view of an antenna system according to one particular embodiment of the invention.

The electronic solution for 3D sweeping is presented with reference to FIG. 13 which is a top view of an antenna system 130 comprising a multilayer antenna according to one embodiment of the invention (with two layers or more) as described here above.

In short, this antenna has a first feeding part (generating a first wave), a radiating part and a guiding part. The guiding part enables the first wave to be guided from the first feeding part up to the radiating part. The guide part comprises two parallel-plate guide type superimposed layers and, for each pair of adjacent layers, first means of transition between the adjacent layers comprising a first reflector working with a plurality of first coupling slots (the characteristics of such a plurality of coupling slots has already been discussed in detail here above).

The antenna system of FIG. 13 furthermore comprises a second feeding part generating a second wave. The guiding part also enables the second wave to be guided from the second feeding part up to the radiating part. The guiding part furthermore comprises, for each pair of adjacent layers, second means of transition between the adjacent layers comprising a second reflector cooperating with a plurality of second slots (the characteristics of such a plurality of coupling slots has already been discussed in detail here above). These second means of transition are offset by 90° relatively to the first means of transition.

In the top view shown in FIG. 13, we can see the radiating part 131 and a first (and respectively second) parabolic reflector referenced P.1 (and P.2 respectively) which is:

- either the reflector of the single first (or respectively second) optical transmission means. This comprises to a two-layer antenna; or
- the last reflector of a combination of first (and respectively second) optical transmission means. This case corresponds to an antenna with more than two layers (each means of transition between two layers being as already described here above, and comprising a reflector and a plurality of coupling slots). The energy comes from the feeding part (one or more sources) situated in the lowest layer and is transferred by the means of transition.

The parabolic reflectors P.1 and P.2 feed the radiating part and for example control the direction of the beam in the planes YZ (plane P in FIG. 18) and XZ respectively. To this end, each of the first and second feeding parts comprises several interlaced sources (as in FIG. 5 for example). Thus, the beam can be pointed in any direction whatsoever of upper space. In other words, by playing on the first and second feeding means, the direction of the maximum radiation of the antenna structure can be found in any direction whatsoever of the semi-space situated above the radiating part (in the direction of the positive Z values).

To this end, leaky wave structures can be used. Their limitation is that of beam frequency squinting. However, for a low bandwidth (<10%), a determined beam operation is possible and the antenna structure is a planar, low-cost, light structure appropriate to 3D electronic sweeping with low losses compared with other approaches such as phased networks.

Figure 14:
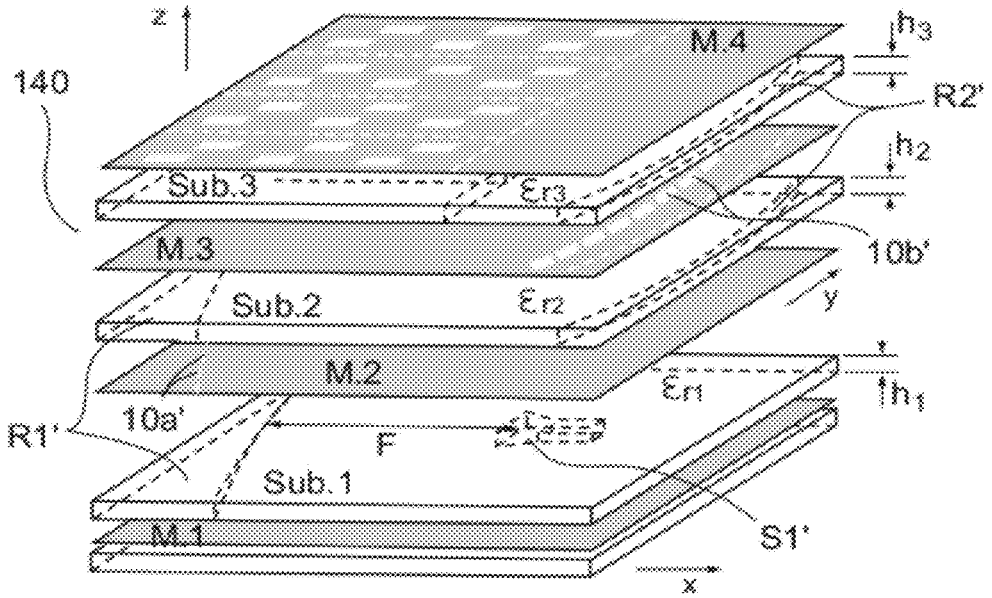
FIG. 14 is a view in perspective of a three-layer antenna according to a first particular embodiment of the invention.
Figure 15:
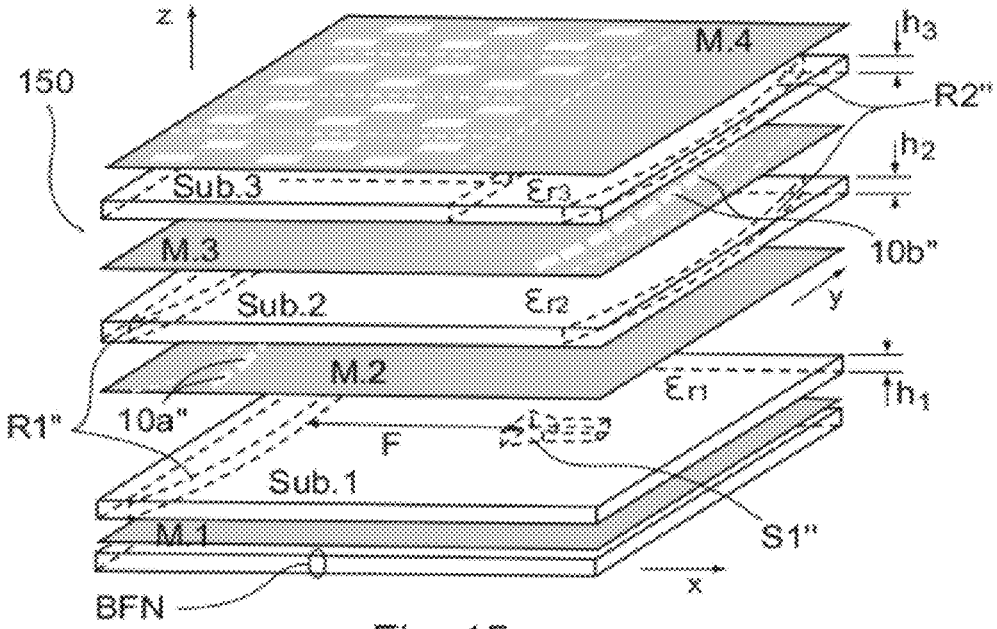
FIG. 15 is a view in perspective of a three-layer antenna according to a second particular embodiment of the invention.

Referring now to FIGS. 14, 15 and 16, we present antennas 140, 150, 160 with three layers in three particular embodiments of the invention.

Other embodiments can be envisaged. Indeed, once it is possible to efficiently transfer energy between two adjacent levels, through the type of means of transition introduced by one or more embodiments of the present invention (with a plurality of coupling slots associated with a reflector), then all the optical configurations commonly used for reflector antennas can be implemented here in a substrate-integrated version (using SIW technology for example).

The antennas of FIGS. 14, 15 and 16 include a feeding part (comprising a source, in this example, but it is also possible with several sources) and a radiating part identical to those of the antenna of FIG. 3. They include a guiding part comprising three parallel-plate layers:

- a first parallel-plate layer itself comprising two metal plates M.1, M.2 situated on either side of a dielectric substrate layer Sub.1 (permittivity $\in_{r1}$);
- a second parallel-plate layer itself comprising two metal plates M.2, M.3 situated on either side of a dielectric substrate layer Sub.2 (permittivity $\in_{r2}$); and
- a third parallel-plate layer itself comprising two metal plates M.3, M.4 situated on either side of a dielectric substrate layer Sub.3 (permittivity $\in_{r3}$).

For the antenna 140 of FIG. 14 (Gregorian type dual reflector system), the guiding part furthermore comprises:

- a first optical means of transition comprising an elliptical reflector R1' and a plurality of coupling slots 10*a*' made in the metal plate M.2; and
- a second optical means of transition comprising a parabolic reflector R2' and a plurality of coupling slots 10*b*' made in the metal plate M.3.

For the antenna 150 of FIG. 15 (a system with a Cassegrain type dual reflector), the guiding part furthermore comprises:

- a first optical means of transition comprising a hyperbolic reflector R1" and a plurality of coupling slots 10*a*" made in the metal plate M.2; and
- a second optical means of transition comprising a parabolic reflector R2" and a plurality of coupling slots 10*b*" made in the metal plate M.3.

For the antenna 160 of FIG. 16, the guiding part furthermore comprises:

- a first optical means of transition comprising a parabolic reflector R1'" and a plurality of coupling slots 10*a*'" made in the metal plate M.2; and
- a second optical means of transition comprising a plane mirror R2'" and a plurality of coupling slots 10*b*'" made in the metal plate M.3.

In the examples of FIGS. 14 and 15, the Gregorian or Cassegrain type dual reflector systems make it possible to reduce the axial size of the optical transmission system and increase performance as regards sweeping capacity in the plane YZ.

In the example of FIG. 16, the use of a plane mirror makes it possible simply to further fold the antenna (third layer) to further reduce its space requirement. Indeed, the plane mirror reflects the plane wave sent by the parabolic reflector (first optical means of transition) without affecting its nature.

In (lower-performance) alternatives embodiments of FIGS. 14, 15 and 16, one of the first and second optical means of transition is made according to an embodiment of the invention (i.e. with a plurality of coupling slots) and the other one is made classically (i.e. with a single coupling slot).

At least one embodiment of the disclosure is aimed especially at proposing a pillbox type parallel-plate multilayer antenna that does not have the drawbacks of the known technical solutions discussed herein.

At least one embodiment proposes an antenna comprising means of transition between two adjacent layers (called a bottom layer and a top layer for example), enabling a transfer of energy that is optimal and efficient in a wide range of angles and frequencies and does so even if these means of transition comprise a reflector that is not plane-shaped (but parabolic for example). It is therefore sought to obtain a perfectly plane wavefront in the top layer (after reflection on the reflector) even if the impinging wavefront of the bottom layer is a wavefront that is not plane (cylindrical for example).

At least one embodiment provides an antenna that can work in double polarization and in circular polarization.

At least one embodiment provides an antenna enabling the use of several excitation sources, and therefore one whose beam is reconfigurable (multiple beams, beam offset, variable directivity beams).

At least one embodiment provides a compact and light antenna.

At least one embodiment provides an antenna that is simple to implement and costs little.

Although the present disclosure has been described with reference to one or more examples, workers skilled in the art will recognize that changes may be made in form and detail without departing from the scope of the disclosure and/or the appended claims.

The invention claimed is:

1. A multilayer antenna comprising:

a feeding part generating a wave;

a radiating part;

a guiding part enabling said wave to be guided from the feeding part to the radiating part, said guiding part comprising:

at least two parallel-plate guide type superimposed layers, and for each pair of adjacent layers, a transition between said adjacent layers, comprising a reflector cooperating with a coupling by slots, wherein, for at least one pair of adjacent layers for which the guiding part comprises a reflector of a non-plane shape, the coupling by slots comprises a plurality of slots, each slot comprising a main body having a shape elongated along at least one axis, said plurality of slots being laid out in at least one row and together forming a pattern that extends along the reflector and has a shape that is a function of the shape of the reflector, said plurality of slots being configured to reduce or eliminate undesirable effects of resonance encountered in a continuous single slot, thus optimizing a transfer of power of said wave between said at least one pair of adjacent layers.

2. The antenna according to claim 1, wherein each slot has a main body having a shape elongated along at least one axis substantially parallel or perpendicular to the reflector.

3. The antenna according to claim 1, wherein at least certain ones of the slots have a main body possessing a shape elongated along only one axis.

4. The antenna according to claim 1, wherein at least certain ones of the slots comprise a main body possessing a cross shape, said main body comprising a first arm having a shape elongated along a first axis and a second arm having a shape elongated along a second axis substantially perpendicular to the first axis.

5. The antenna according to claim 1, wherein the shape of the pattern formed together by said plurality of slots is substantially identical to that of the reflector.

6. The antenna according to claim 1, wherein each slot of said plurality of slots has:

a length ($l_{si}$) ranging from $0.25*\lambda_d$ to $0.5*\lambda_d$; and a width ($w_{si}$) ranging from $0.1*\lambda_d$ to $0.2*\lambda_d$, with $\lambda_d$ being the wavelength in the parallel-plate guide type superimposed layers, at the operating frequency of the antenna.

7. The antenna according to claim 1, wherein each slot of said plurality of slots is at a distance, relative to the reflector, ranging from $0.3*\lambda_d$ to $0.5*\lambda_d$, with $\lambda_d$ being the wavelength in the parallel-plate guide type superimposed layers, at the operating frequency of the antenna.

8. The antenna according to claim 1, wherein the distance between two adjacent slots of said plurality of slots ranges from $0.02*\lambda_d$ to $0.1*\lambda_d$, with $\lambda_d$ being the wavelength in the parallel-plate guide type superimposed layers at the working frequency of the antenna.

9. The antenna according to claim 1, wherein said feeding part comprises at least two sources that are mutually interlaced, physically or electrically.

10. An antenna system comprising:

a multilayer antenna, comprising:

a first feeding part generating a first wave;

a radiating part;

a guiding part enabling said first wave to be guided from the first feeding part to the radiating part, said guiding part including at least two parallel-plate guide type superimposed layers and, for each pair of adjacent layers, a first transition between said adjacent layers, comprising a first reflector cooperating with a first coupling by slots;

a second feeding part generating a second wave, wherein said guiding part also enables said second wave to be guided from the second feeding part up to the radiating part, said guiding part moreover comprising, for each pair of adjacent layers, a second transition between said adjacent parts comprising a second reflector cooperating with a second coupling by slots, said second transition being offset by 90° relative to said first transition, for at least one pair of adjacent layers for which the guiding part comprises a reflector of a non-plane shape, the first coupling by slots comprises a plurality of first slots, each first slot possessing a shape elongated along at least one axis, said plurality of first slots being positioned on at least one row and together forming a pattern that extends along the first reflector and has a shape that is a function of the shape of the first reflector, said plurality of first slots being configured to reduce or eliminate undesirable effects of resonance encountered in a continuous single slot, thus optimizing a transfer of power of said first wave between said at least one pair of adjacent layers, for at least one pair of adjacent layers for which the guiding part comprises a reflector of a non-plane shape, the second coupling by slots comprises a plurality of second slots, each second slot possessing a shape elongated along at least one axis, said plurality of second slots being positioned on at least one row and together forming a pattern that extends along the second reflector and has a shape that is a function of the shape of the second reflector, said plurality of second slots being configured to reduce or eliminate undesirable effects of resonance encountered in a continuous single slot, thus optimizing a transfer of power of said second wave between said at least one pair of adjacent layers.

* * * * *